US008938823B2

(12) United States Patent
Drozdowich et al.

(10) Patent No.: US 8,938,823 B2
(45) Date of Patent: Jan. 27, 2015

(54) LAMINATE COUNTERTOP INSERT AND TEMPLATE

(75) Inventors: Bryan Gordon Drozdowich, Abbotsford (CA); Peter Zurba, Pitt Meadows (CA)

(73) Assignee: Counter-Seal Corp., Port Coquitlam, British Columbia (CA)

( * ) Notice: Subject to any disclaimer, the term of this patent is extended or adjusted under 35 U.S.C. 154(b) by 778 days.

(21) Appl. No.: 12/994,715

(22) PCT Filed: Jul. 23, 2009

(86) PCT No.: PCT/CA2009/001046
§ 371 (c)(1),
(2), (4) Date: Jan. 24, 2011

(87) PCT Pub. No.: WO2010/009556
PCT Pub. Date: Jan. 28, 2010

(65) Prior Publication Data

US 2011/0300331 A1 Dec. 8, 2011

Related U.S. Application Data

(60) Provisional application No. 61/129,876, filed on Jul. 25, 2008.

(51) Int. Cl.
*E03C 1/33* (2006.01)
*A47B 77/06* (2006.01)

(52) U.S. Cl.
CPC .. *A47B 77/06* (2013.01); *E03C 1/33* (2013.01)
USPC ..... 4/631

(58) Field of Classification Search
USPC ..... 4/631–636, 649, 660
See application file for complete search history.

(56) References Cited

U.S. PATENT DOCUMENTS

| | | | | |
|---|---|---|---|---|
| 1,956,314 | A | | 4/1934 | Carter, Jr. |
| 2,158,467 | A | * | 5/1939 | Madsen ..... 4/631 |
| 3,668,033 | A | | 6/1972 | Evans |
| 3,846,217 | A | | 11/1974 | Grosheim |
| 4,374,695 | A | * | 2/1983 | Ikeda et al. ..... 156/293 |
| 4,718,741 | A | * | 1/1988 | Nichoalds ..... 312/223.6 |
| 5,310,435 | A | * | 5/1994 | Kelly ..... 156/182 |
| 5,551,103 | A | | 9/1996 | Drozdowich et al. |
| 5,754,991 | A | | 5/1998 | Drozdowich et al. |
| 6,108,831 | A | * | 8/2000 | Lombreglia, Jr. ..... 4/631 |
| 6,110,313 | A | | 8/2000 | Ford |

(Continued)

FOREIGN PATENT DOCUMENTS

| | | | |
|---|---|---|---|
| CN | 85102349 | A | 1/1987 |
| CN | 1441132 | A | 9/2003 |

(Continued)

*Primary Examiner* — Huyen Le
*Assistant Examiner* — Erin Deery
(74) *Attorney, Agent, or Firm* — Morgan, Lewis & Bockius LLP; Victor E. Johnson

(57) ABSTRACT

In one aspect, the invention provides an insert that is incorporated into laminated countertops during fabrication of stock countertop material. Once installed, a guide portion of the insert serves as a template for the later removal of a selected cut-out portion of the insert, to leave an opening in the countertop defined at least in part by a remaining portion of the insert. In this way, the insert may for example serve as both a template for cutting a sink opening in a laminated countertop, and as a component of a sink undermounting system in the laminated countertop.

10 Claims, 9 Drawing Sheets

(56) References Cited

U.S. PATENT DOCUMENTS

| | | | | |
|---|---|---|---|---|
| 6,349,429 | B1 | 2/2002 | Zurba et al. | |
| 6,551,678 | B1 | 4/2003 | O'Brien et al. | |
| 7,007,317 | B1 * | 3/2006 | Brown | 4/631 |
| 2003/0159208 | A1 | 8/2003 | Mayer et al. | |

FOREIGN PATENT DOCUMENTS

| | | | |
|---|---|---|---|
| CN | 2861302 | Y | 1/2007 |
| DE | 4041586 | C1 | 10/1991 |
| WO | WO 96/04820 | | 8/1995 |
| WO | WO 96/04820 | A1 | 2/1996 |

* cited by examiner

LAMINATE COUNTERTOP INSERT AND TEMPLATE

CROSS-REFERENCE TO RELATED APPLICATIONS

This application is a National Stage under 35 U.S.C. 371 of PCT/CA2009/001046 filed Jul. 23, 2009 which claims priority under 35 U.S.C. §119(e) from U.S. Provisional application No. 61/129,876 filed Jul. 25, 2008, the entire contents of which are incorporated herein by reference in their entireties for all purposes.

FIELD OF THE INVENTION

The invention is in the field of countertop fabrication, providing methods and devices for under-mounting fixtures, such as sinks, to laminated countertops.

BACKGROUND OF THE INVENTION

Laminated countertops are constructed with a thin surface layer of plastic laminate, such as FORMICA™ brand laminate from the Formica Corporation, Cincinnati, Ohio. The laminate is generally made up of layers of colored paper impregnated with polymeric resin and pressed into sheet stock. For example, a plurality of paper core sheets may be impregnated with a thermosetting phenolic resin and surfaced with a decorative sheet which is impregnated with a noble thermosetting resin. Exemplary laminates are disclosed in U.S. Pat. Nos. 1,956,314; 3,846,217 and 6,551,678. Alternative forms of lamination are known, such as NUVEL™ by the Formica Corporation, as for example described in U.S. Pat. No. 6,110,313.

The surface of a laminated countertop is typically bonded to a wood fibre core, such as plywood, particleboard or flake board. A wide variety of methods, adhesives and machines may be used for attaching the laminate to the core, as for example are disclosed in U.S. Pat. No. 3,668,033. These process include both stationary and continuous processes, and typically involve the application of heat and pressure to affix the laminate to the core.

To mount a sink in a laminated countertop, a cross-sectional hole must be cut through the laminate and core. The wood fibre core exposed by the cross-sectional cut is generally porous, so that a seal must be used to exclude water from the unlaminated, cut edge of the countertop. Typically, this is achieved by dropping a sink with an upper circumferential flange into the mounting aperture from above, and sealing the flange against the laminated countertop.

The traditional mounting for flanged drop-in sink gives rise to a number of problems. Because the flange is raised or beveled, it is not possible to run cleaning solution over it freely, since the cleaner would not run back into the sink but out over the countertop. Perhaps more importantly, if the seal between the sink flange and the countertop laminate deteriorates, water can leak down into the exposed porous wood fibre edge of the countertop core. The positioning of the flange above the wood fibre edge facilitates this undesirable flow. Eventually, the countertop may suffer structural failure as the wetted core first swells, then looses its structural integrity altogether. Even before the fibre core fails, however, the area beneath a leaking sink flange may become an unsanitary habitat for the proliferation of microorganisms.

There are a variety of ways in which a sink may be mounted to the underside of an aperture cut in a laminated countertop, as for example are disclosed in International Patent Publication WO 96/04820 and U.S. Pat. Nos. 5,551,103; 5,754,991; 6,349,429. In some cases, somewhat elaborate manufacturing steps may be employed to effectively undermount a sink in a laminated countertop, as for example described in U.S. Pat. No. 7,007,317.

SUMMARY OF THE INVENTION

In one aspect, the invention provides an insert that is incorporated into laminated countertops during fabrication of stock countertop material. Once installed, a guide portion of the insert serves as a template for the later removal of a selected cut-out portion of the insert, to leave an opening in the countertop defined at least in part by a remaining portion of the insert. In this way, the insert may for example serve as both a template for cutting an opening in a laminated countertop, and as a component of a sink undermounting system in the laminated countertop.

In one aspect, the invention provides a countertop mounting unit, adapted to provide a sealed opening in an countertop which may be used, for example, for under-mounting a fixture to a laminated countertop or for providing a sealed passage through the countertop. The countertop may be fabricated from a porous deck sheet having a cross-sectional edge defining an aperture in the sheet. A non-porous insert may be positioned to occupy the aperture in the sheet, the perimeter of the insert being bonded by an adhesive to the cross-sectional edge in the sheet. The top surface of the insert may be generally coplanar with the top surface of the deck sheet, to facilitate bonding of a non-porous laminate sheet to the top surface of the deck sheet and to the top surface of the insert. A recessed portion of the bottom surface of the insert may be formed above a plane defined by the bottom surface of the deck sheet. The recessed portion may be defined by a downwardly-projecting circumferential rim, forming a portion of the bottom surface of the insert. In this way, the rim may serve as a template or jig to guide the removal of the recessed portion of the insert, to provide access to a fixture that is mounted beneath the countertop on the bottom surface of the insert.

In selected embodiments, a circumferential drip groove water trap may be formed on the bottom surface of the insert, to provide a discontinuity between the rim and the cross-sectional edge, serving to prevent water from creeping across the bottom surface of the insert into the porous countertop sheet material.

Reinforcing projections may be provided on the recessed portion of the bottom surface of the insert, to reduce the amount of material required to form the insert while strengthening the recessed portion of the insert so that it can accommodate the compressive forces required during various fabrication steps, such as lamination of the countertop. The reinforcing surfaces may be generally coplanar with the bottom surface of the deck sheet, to simplify processing of the whole countertop unit (arranged, for example, so that no portion of the bottom surface of the insert extends below the plane formed by the bottom surface of the deck sheet). In some embodiments, the reinforcing portions may be arranged so as to provide additional circumferential rims within the recessed portion of the insert. For example, the reinforcing portions may be concentrically located within the recessed portion defined by the rim.

The mounting unit may be adapted for attachment of a fixture, such as an undermount sink, having a circumferential outwardly extending upper flange. The fixture may be attached so that the flange is in sealing engagement with the bottom surface of the insert. The fixture may be positioned, and the insert adapted, so that the circumferential drip groove water trap is spaced apart from a distal edge of the flange. Fixtures may for example be provided with inserts in kits, with the fixtures sized for sealing engagement with the bottom surface of the insert.

In an alternative aspect, the invention provides methods for inserting a mounting unit in a laminated countertop for undermounting a fixture, in which a non-porous insert of the invention is inserted into a porous deck sheet, to occupy the aperture in the sheet. The perimeter of the insert is bonded to the cross-sectional edge in the sheet, to seal the edge. A non-porous laminate sheet may then be bonded in sealing engagement with the top surface of the deck sheet and to the top surface of the insert. A laminating pressure may be applied to the unit, to compress the laminate onto the top surface of the deck sheet and the top surface of the insert, for example with platens or rollers bearing on the laminate sheet and the bottom surface of the deck sheet. The reinforcing portions of the insert serve to strengthen the insert during lamination, to help ensure a sealing bond is uniformly formed on the top surface of the unit.

In an alternative aspect, the invention provides a deck sheet port for use in a laminated countertop, with a deck sheet port fitting occupying a port in the deck sheet. The perimeter of the port fitting may be adhesively bonded to the cross-sectional cut in the sheet, and the top surface of the port fitting may be bonded to the underside of the laminate sheet. A relief hole in the top surface of the port fitting may be provided to permit passage of a fluid, such as adhesive, out of the space between the laminate and the top surface of the port fitting. In this way, the port fitting may be inserted into the underside of a deck sheet, beneath a laminate layer, while avoiding the risk that the insertion of the fitting will bias a layer of adhesive against the underside of the laminate, displacing the laminate from the top of the deck sheet. The port fitting may include a circumferential flange sized to abut a bottom surface of the deck sheet, so that the flange serves to limit the extent of insertion of the fitting, again serving to avoid the risk that the insertion of the fitting will displace the laminate from the top of the deck sheet. A circumferential drip groove water trap may be provided on the bottom surface of the flange, forming a discontinuity on a bottom surface of the flange that prevents water from leaching past the flange into the porous deck sheet material.

To install the deck sheet port in a laminated countertop, the deck sheet port fitting may be inserted to occupy the port in the sheet, so that a top surface of the port fitting is generally coplanar with the top surface of the deck sheet. The port fitting may be bonded with an adhesive to the cross-sectional cut in the sheet; and, the top surface of the port fitting may be bonded to the laminate with a sealing adhesive, while permitting passage of the sealing adhesive out of the space between the laminate and the top surface of the port fitting through the relief hole in the top surface of the port fitting. The relief hole may also be used as a guide for cutting the port through the laminated countertop, by cutting a hole through the top portion of the port fitting centered on the relief hole, for example using a hole saw bit with a centered pilot boring bit driven through the relief hole.

In an alternative aspect, the invention provides a countertop mounting unit that makes use of an annular non-porous insert occupying the aperture in the sheet, defining an opening in the countertop. A fixture mounting surface on the bottom surface of the insert may be adapted for sealing engagement with a fixture, with a circumferential drip groove water trap formed on the bottom surface of the insert, spaced apart from the fixture mounting surface. For example, the insert may have an outwardly extending circumferential flange projecting below the perimeter of the insert, and the fixture mounting surface and the drip groove water trap may be formed on a bottom surface of the flange.

DETAILED DESCRIPTION OF THE INVENTION

Figure 1:
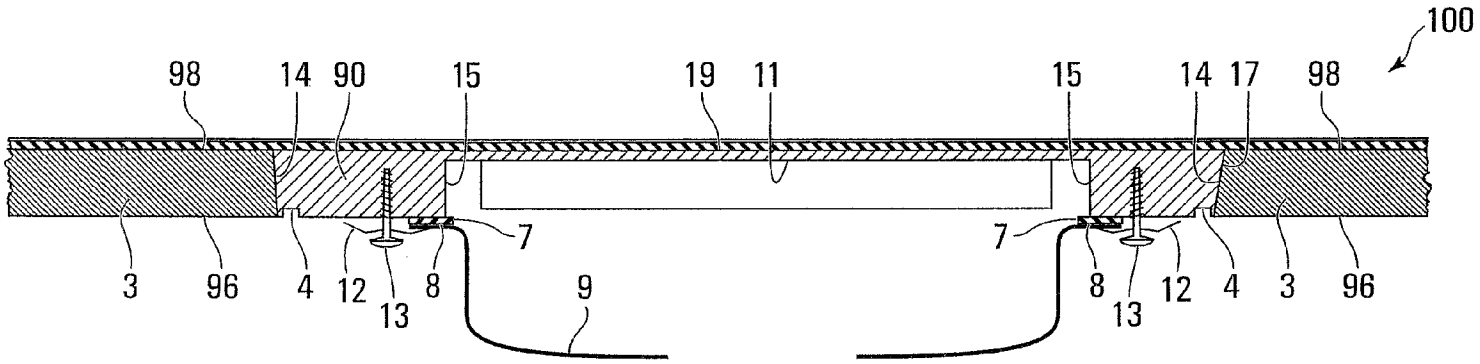
FIG. 1 is an elevational front view in cross section of a mounting unit installed in a laminated countertop supporting a fixture.
Figure 2:
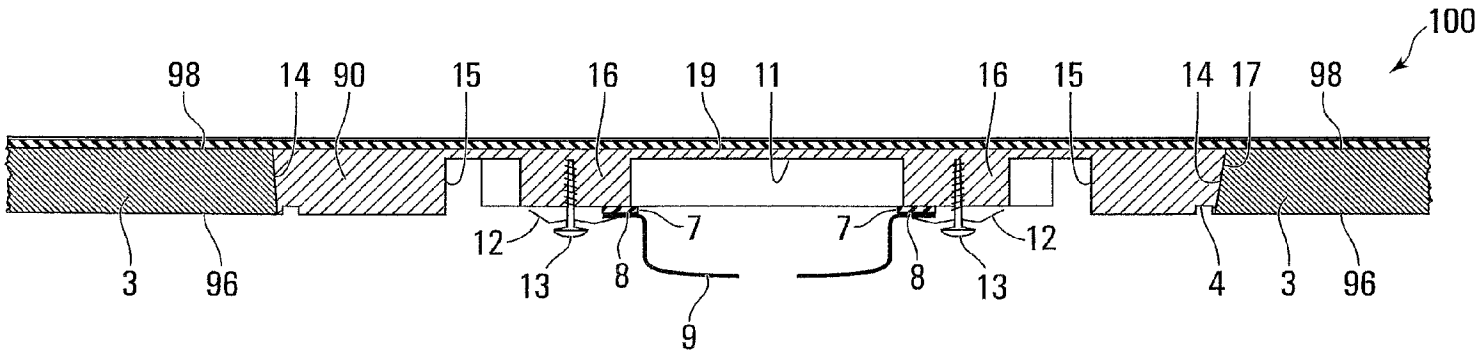
FIG. 2 is an elevational side view in cross section of an alternative mounting unit of the invention installed in a laminated countertop supporting a fixture.

As shown in FIGS. 1 and 2, one aspect of the invention is a countertop mounting unit 100, which may be used for under-mounting a fixture 9 in a laminated countertop or to provide a sealed opening in a countertop. For example, the sealed opening may be useful for providing access through the countertop to any of a variety of fixtures or containers, for example providing a chute through the countertop to a garbage container that sits below the countertop. The countertop may be fabricated from a porous deck sheet 3, such as a wood fibre sheet. Alternative materials for sheet 3 include plywood, particleboard, chipboard, flakeboard, MDF, solid wood or a polymeric substrate. The deck sheet 3 will typically have a generally planar top surface 98 and a generally planar bottom surface 96. To provide access to an under-mounted fixture 9, a cross-sectional edge 14 is cut in the sheet 3, defining an aperture in sheet 3. The wood fibre core exposed by the cross-sectional cut 14 will generally be porous, leaving the sheet 3 susceptible to water damage.

Figure 3:
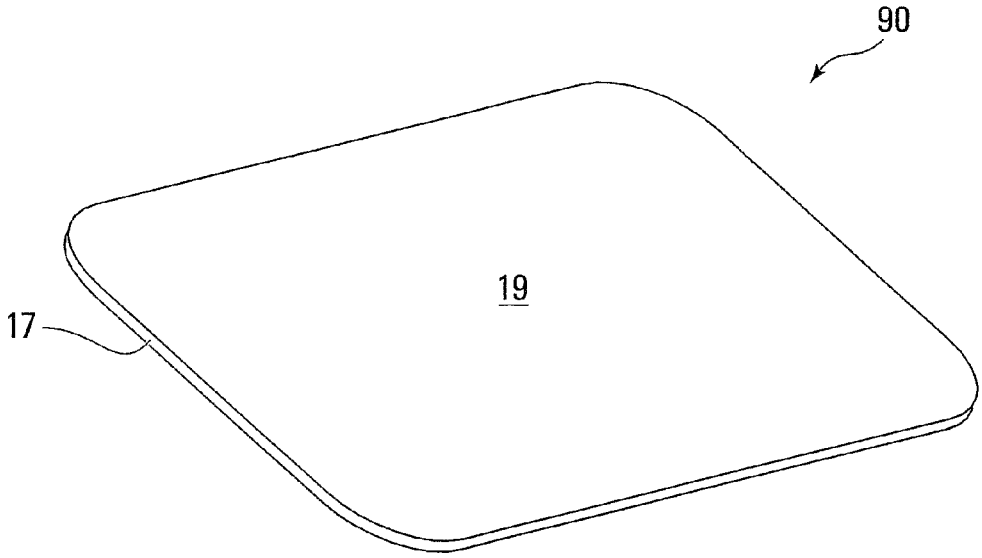
FIG. 3 is an isometric view of the top surface of a non-porous countertop deck sheet insert of the invention, illustrating the perimeter of the insert [which is adapted for adhesive bonding to a cross-sectional edge defining an aperture in the deck sheet].
Figure 4:
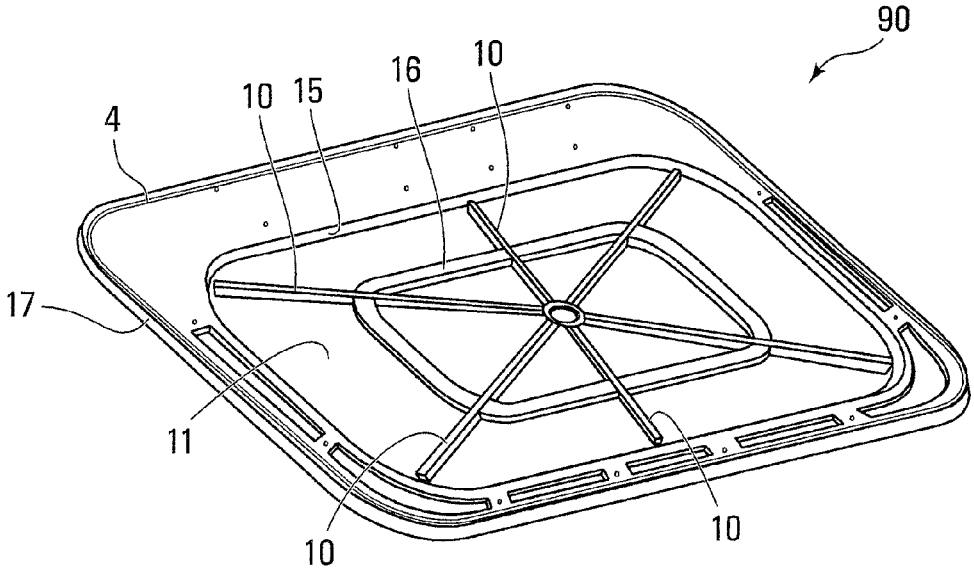
FIG. 4 is an isometric view of the bottom surface of a non-porous countertop deck sheet insert of the invention, illustrating the recessed portion of the bottom surface of the insert as shown in cross section in FIG. 2.

The invention accordingly provides a non-porous insert 90, shown in FIGS. 3 and 4, adapted to occupy the aperture in sheet 3. Once the insert 90 is placed in the aperture, the perimeter 17 of the insert is bonded to the cross-sectional edge 14 in the sheet. In general, this bond will be formed with an adhesive, preferably a water-resistant adhesive, so that the porous cross-sectional edge 14 in the sheet is sealed by the adhering perimeter 17 of the insert. In selected embodiments, the top surface 19 of the insert 90 will be generally coplanar with the top surface 98 of the deck sheet 3, to facilitate contemporaneous lamination of the co-planar top surfaces 98, 19.

Figure 5:
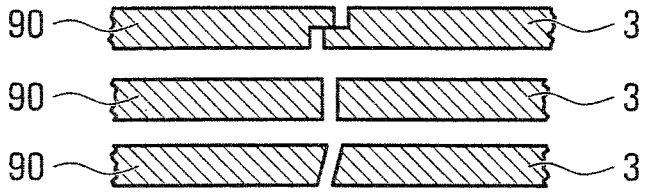
FIG. 5 is a schematic elevational side view in cross section, partially broken away, illustrating three alternative conformations of mating surfaces between the cross-sectional edge defining an aperture in a deck sheet and the perimeter of a deck sheet insert.
Figure 6:
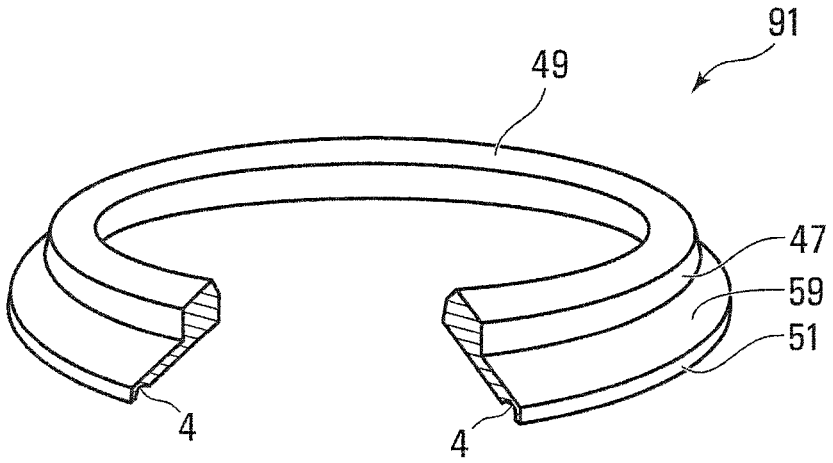
FIG. 6 is an isometric view, partially broken away, showing the top surface and cross-sectional profile of a mounting unit ring having a circumferential drip groove water trap on the periphery of the bottom surface.

The dimensions of the insert may vary widely. For example, in thickness of the insert may be between ⅝" and 2", for example 11/16" or ¾". The width of the insert 90 may vary widely, for example to accommodate wide range of under-mount sink sizes, for example being between 6" and 40" wide, and between 10" and 22" from back to front. The layout of the insert may also vary widely, again to suit a wide range of fixtures. In the illustrated embodiments, the insert 90 has radiused corners, but other conformations may be preferred in alternative embodiments. The perimeter 17 of the insert may have a variety of profiles, as shown in FIG. 5, including a profile for lap jointing to the deck sheet, or a bevel for mating with a corresponding bevel on the deck sheet. In selected embodiments, a 4 degree bevel may be selected. The insert 90 may for example be manufactured by machining, casting or moulding, of polymeric or other materials. For example, the insert may be fabricated from polymeric materials such as an epoxy, nylon, acrylic, PVC, ABS, polyester, or mineral filled solid surfaces materials.

Insert 90 is adapted to facilitate application of a laminate to the deck sheet with the insert in place. In this aspect of the invention, a non-porous laminate sheet 1 may be bonded to the top surface 98 of the deck sheet 3 and to the top surface 19 of the insert 90. The laminate may be attached, for example with an adhesive, in sealing engagement with the top surfaces of the deck sheet and insert. In some embodiments, the laminate and deck sheet may for example be manipulated for post forming and/or cove forming, for example by stationary forming techniques, or by continuous forming techniques.

In some embodiments, the bottom surface of the deck sheet insert may have a recessed portion 11, formed above a plane defined by the bottom surface of the deck sheet. The recessed portion will be less thick than other portions of the insert, being for example ⅛" or ¼" thick. The recessed portion 11 may be circumscribed by a downwardly-projecting circumferentially-continuous rim 15 forming a portion of the bottom surface of the insert 90. Reinforcing projections 10 may be provided that project downwardly from the recessed bottom surface 11 of the insert 90. The projections 10 may be adapted to form reinforcing surfaces that are generally coplanar with the bottom surface 96 of the deck sheet 3. In selected embodiments, no portion of the bottom surface of the insert, including the reinforcing projections, extends below the plane formed by the bottom surface of the deck sheet. In this way, the insert is adapted to be generally coplanar with the deck sheet on the top and bottom surfaces of the countertop mounting unit. This coplanar arrangement may facilitate lamination of the countertop mounting unit with the insert in place, for example by application of a stationary platen press, or moving rollers, to apply the laminate. The reinforcing projections 10 on the recessed portion 11 of the insert 90 serve to ensure that the top surface 19 of the recessed portion can accept a biasing force to apply the laminate 1, while minimizing the amount of material required to build the insert.

In alternative embodiments, the bottom surface of the insert is not coplanar with the bottom of the deck sheet. For example, inserts that are approximately ¾" thick, corresponding to deck sheets in some jurisdictions, may be used with deck sheets that are only ⅝" thick, being the standard deck sheet thickness in other jurisdictions. In these embodiments, the reinforcing projections on the recessed portion of the insert may nonetheless serve to support biasing forces applied to the top and bottom of the insert, so as to prevent the displacement of the top surface of the insert by a force applied thereto.

The downwardly-projecting circumferentially-continuous rim 15 that defines the recessed portion 11 of the insert 90 may be used to guide the removal of a portion of the insert 90, to create an aperture in the insert. For example, the rim may serve as a router guide, when used for example as the bearing surface for a pilot bit, such as a ½" shank cutting surface bit with a bottom bearing. The bearing follows the rim as the bit moves around the recessed portion of the insert, so that the recessed portion 11 is cut out of the laminate countertop. In this way, the provision of a recessed portion on the insert serves both to reduce material costs associated with making the insert, and provides an integral jig in the insert which facilitates cutting the opening for a fixture.

Once the opening for a fixture has been made in the insert, the side walls of the remaining part may have a wide variety of dimensions, suited for use with different fixtures. For example, the remaining portions of the insert may be at least 2" wide at the front and sides, and 4" wide at the rear. A relatively wide rear deck on the insert facilitates mounting of faucets or other hardware, for example by drilling passages through the rear deck. The dimensions of the remaining portion of the insert may be selected to facilitate under-mounting of a fixture, particularly the circumferential upper flange of a fixture such as a sink. As illustrated in FIGS. 1 and 2, a removable fastener 13 holding a clip 12 may be used to secure the fixture to the insert, with fasteners inserted to hold the clips around the perimeter of the insert. The insert may be adapted for this by providing pilot holes for the fasteners. For example, for a typical kitchen sink, 10-15 pilot holes may be placed in various locations around the perimeter of the underside of the insert, so that screws can be placed in the insert to clip the sink to the underside of the insert. A channel may be provided in the underside of the insert, to permit a gasket 7 to be housed in the portion of the insert against which the flange of a fixture will be seated. The channel may for example be provided about ¼" in from edge of the opening in the insert. When a fixture is mounted, a sealer 8 may also be applied between the flange of the fixture and the underside of the insert, such as a silicone sealer.

In some embodiments, the reinforcing projections 10 on the bottom surface of the recessed portion of the insert may also serve as secondary guides, for the removal of alternative portions of the insert. For example, a plurality of reinforcing projections may be concentrically arranged, with each projection forming a continuous circumferential guide for removing a selected portion of the insert. In such an embodiment, the reinforcing projections in effect form additional downwardly-projecting circumferentially-continuous rims 15 on the recessed portion 11 of the bottom surface of the insert. FIGS. 2 and 4 illustrate one such additional rim 16 formed from a projection on the recessed portion of the insert. In this way, the insert may for example be adapted for use with a variety of fixtures. For example, the rim and projections may be sized for use with a variety of undermount sinks. The reinforcing projections may be arranged in a wide variety of patterns, including patterns in which the projections intersect. Where intersections between the projections occur, a fabricator can adapt the projections for use as a jig with a desired fixture by removing segments of the intersecting portions, to leave a continuous circumferential guide surface.

In alternative embodiments, the invention provides templates shaped to mate with the bottom surface of the insert, to in effect form additional downwardly-projecting circumferentially-continuous rims on the recessed portion of the bottom surface of the insert. These templates may be temporary, adapted to be used as a jig to guide the removal of material from the insert. Alternatively, the templates may be adapted to be affixed to the insert, for example with an adhesive, to adapt the contours of the underside of the insert.

In selected embodiments, the invention provides kits that include a mounting unit and one or more fixtures. In these kits, the rim and/or reinforcing projections on the insert may be shaped to provide both a jig for removal of an appropriate portion of the insert, as well as being shaped to provide an appropriate bearing surface for sealing engagement with an upper circumferential flange on the selected fixture.

In another aspect of the invention, a circumferential drip groove water trap 4 is provided in the bottom surface of the insert. The water trap may for example be sited close to the perimeter of the insert, as shown in FIG. 4, and may for example be ⅛" to ¼" deep. The water trap forms a discontinuity on the bottom surface of the insert, between the rim and the cross-sectional edge. This discontinuity is shaped to cause water to drip off the bottom surface of the insert, rather than travelling along the bottom surface of the insert and onto the adjoining countertop sheet material. In this way, the insert includes a mechanism for ensuring that the porous sheet material is protected from water damage. For example, in the event of a failure in the seal between the insert and the upper flange of an under-mounted fixture, water passing through the failed seal encounters the water trap, drips off the trap, and is thereby prevented from reaching the junction between the insert and the porous underside of the countertop sheet. In these aspects of the invention, the fixture for use with the insert of the invention may be selected and mounted to utilize the drip groove. In particular, the fixture may have a circumferential outwardly extending upper flange adapted for sealing engagement with the bottom surface of the insert, so that the circumferential drip groove water trap is beyond the distal edge of the flange. When the fixture is adapted and mounted in this way, water passing between the abutting surfaces of the flange and the insert will encounter the drip groove before reaching the deck sheet.

Figure 7:
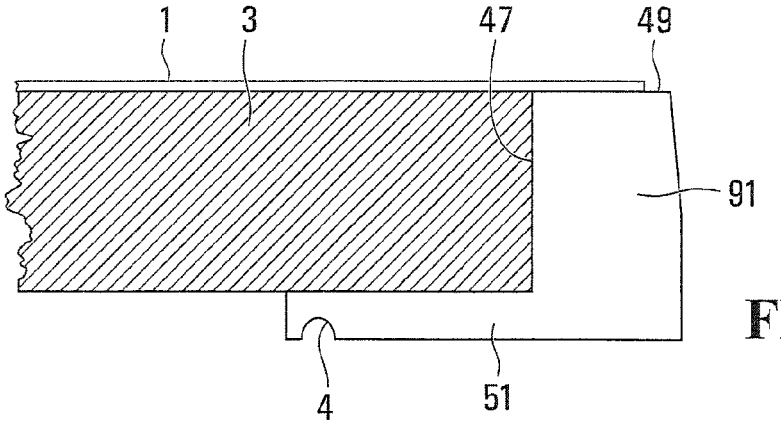
FIG. 7 is an elevational view in cross section, showing the cross-sectional profile of the ring of FIG. 6, installed in a deck sheet, illustrating the outwardly extending circumferential flange on the ring abutting the bottom surface of the deck sheet.
Figure 8:
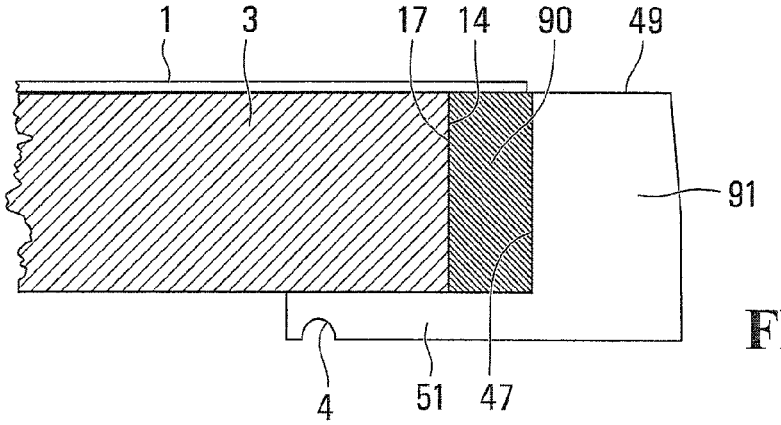
FIG. 8 is an elevational view in cross section, showing the cross-sectional profile of the ring of FIG. 6, installed in a deck sheet within the opening cut in the deck sheet insert of FIGS. 3 and 4, illustrating the outwardly extending circumferential flange on the ring abutting the bottom surface of the insert and the deck sheet.

As illustrated in FIGS. 6, 7, 8 and 9, an alternative aspect of the invention provides a non-porous ring 91 adapted for insertion into an aperture, such as an aperture formed in a porous countertop deck sheet. In effect, the ring 91 is an adaptation of insert 90, in which a portion of the insert 90 is removed to leave the annular ring 91. The ring 91 may include a circumferential drip groove water trap 4, as described above. As illustrated, the ring 91 may have upper surfaces adapted for bonding to porous countertop sheet material, for example by sandblasting, including the upper surface 59 of an outwardly extending circumferential flange 51. When installed, the upper surface 59 of the ring flange may cover a segment of the deck sheet, as shown in FIGS. 7 and 8. In an alternative embodiment, shown in FIG. 9, the flange 51 may be positioned below the bottom surface of the deck sheet 3. In such an embodiment, ring 91 may optionally be positioned by spacer 53 that is positioned between the flange 51 and the bottom surface of deck sheet 3.

As shown in FIG. 7, laminate 1 may be installed on the top surface of the deck sheet 3 and the ring 91, bridging the junction between the ring and the deck sheet. The ring may be installed before or after the laminate is applied. To install the ring after laminating the sheet, material below the laminate is removed, for example with a router, to expose an overhanging laminate lip, and the ring is then installed so that the top surface 49 of the ring 91 adheres to the underside of the overhanging laminate lip.

In alternative embodiments, as shown in FIG. 8, the ring 91 may be affixed to an opening cut in the insert 90. For example, the ring 91 may be used to adapt the opening in an insert 90, for use with an alternative fixture. Accordingly, the insert 90 may be provided with a rim 17 or with reinforcing projections 10 that define a removable portion in the insert 90 which corresponds to the dimensions of the outer ring surface 47 on the ring 91. In this way, the ring 91 may serve as an adapter for the insert 90, for example to increase the range of fixtures 9 that may be used with a selected insert. In some embodiments, the materials out of which the ring and the insert are formed may be selected so that the adhesive bond between the ring and the insert is particularly strong and waterproof. If this is accomplished, the countertop laminate need not bridge the joint between the ring and the insert, so that the laminate only bridges the joint between the insert and the porous countertop sheet, as shown in FIG. 8.

Figure 9:
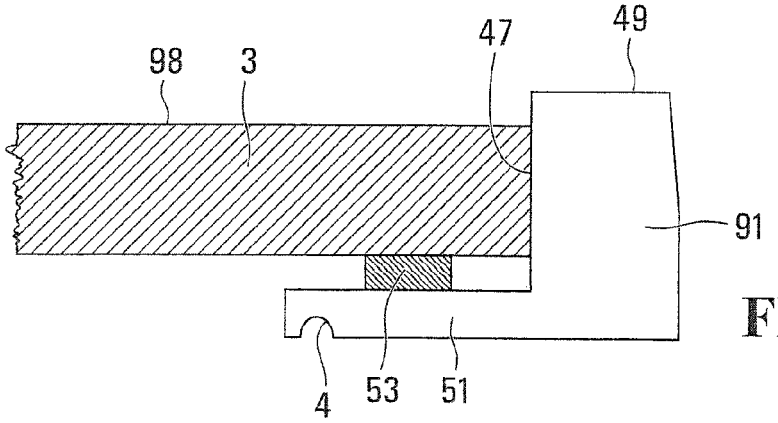
FIG. 9 is an elevational view in cross section, showing exemplary profiling of a ring of FIG. 6.

FIG. 9 illustrates an alternative embodiment, in which the top surface 49 of ring 91 projects above the top surface 98 of deck sheet 3. In such an embodiment, a laminate sheet or tile may optionally be applied to the top surface 98 of sheet 3 so that it abuts the raised lip of outer ring surface 47.

As illustrated in FIGS. 10 through 16, another aspect of the invention is a deck sheet port fitting 64. The illustrated embodiment is a cylindrical hollow fitting defined by side walls 65. In some embodiments, the port fitting is adapted to be inserted into a countertop after lamination. To facilitate this, the port fitting 64 is provided with a relief hole 69 in a top surface 61. In use, the relief hole 69 allows the fitting 64 to be pressed into the underside of the deck sheet 3 of a laminated countertop, while ameliorating the risk that the insertion of the port fitting 64 will force adhesive against the underside of the laminate 1, causing the laminate 1 to separate from the adjoining area of the countertop deck sheet top surface 98. The relief hole 69 allows adhesive to escape from between the laminate 1 and the upper surface 61 of the fitting 64, leaving an appropriately thin layer of adhesive to bond the top surface 61 of the fitting 64 to the underside of the laminate 1.

Once the fitting 64 is installed in a deck sheet 3, beneath a laminate 1, the relief hole 69 may be used as a drill guide, so that a drill bit can be driven to puncture the laminate 1 using the relief hole 69 as a guide and bushing. The resulting hole in the laminate can then be used as a guide for a hole saw, dimensioned to remove a portion of the laminate and a portion of the top surface 61 of the fitting 64 adhered to the laminate 1, opening a passage through the deck sheet defined by the walls 65 of the fitting 64. The upper circumferential portions of the fitting may remain bonded to the laminate, to prevent water from seeping into the deck sheet. The locations of the port fittings in the laminated countertop may also be identified with markings or stickers on the top, laminated surface of the countertop.

Figure 10:
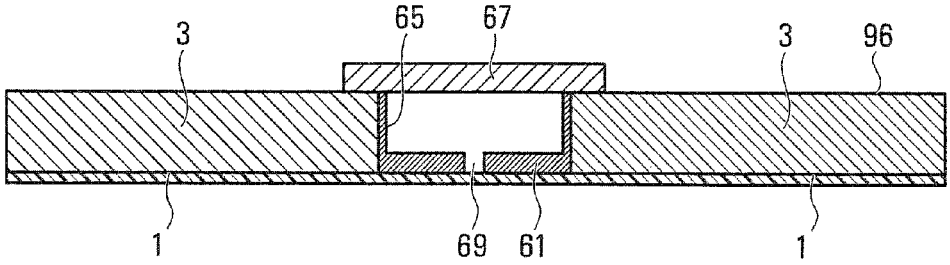
FIG. 10 is an elevational view in cross section, showing a deck sheet port fitting, positioned in a laminated countertop, illustrating a flange in the fitting that abuts the bottom surface of the deck sheet to position the fitting.
Figure 11:
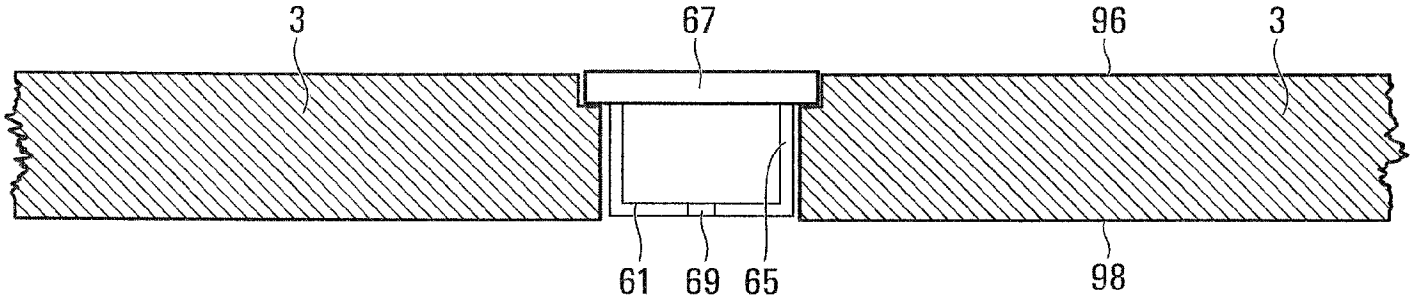
FIG. 11 is an elevational view in cross section, showing an alternative deck sheet port fitting positioned in a laminated countertop, illustrating a flange in the fitting that is seated in the deck sheet, so that the bottom of the flange is coplanar with the bottom surface of the deck sheet.
Figure 12:
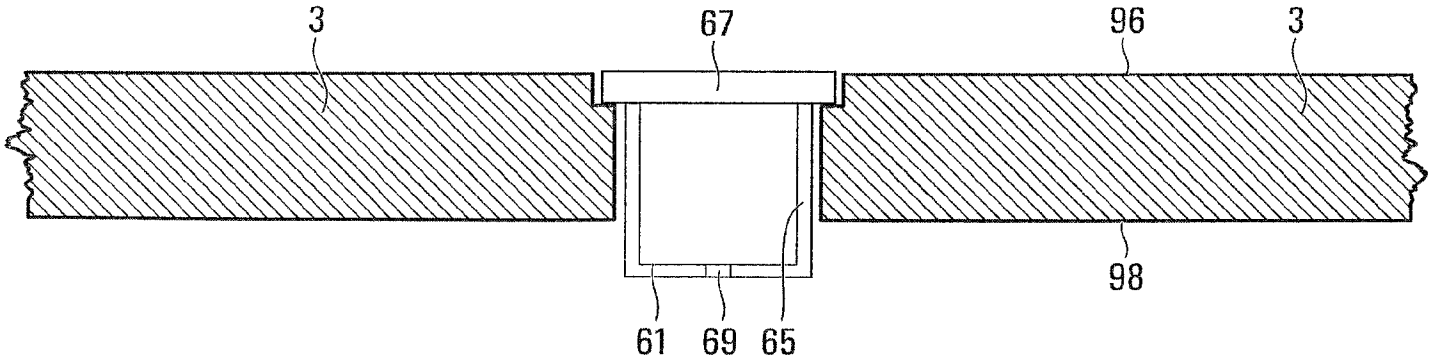
FIG. 12 is an elevational view in cross section, showing an alternative deck sheet port fitting positioned in a laminated countertop, illustrating a flange seated in the deck sheet, as in FIG. 11, in which the top side of the fitting projects above the top of the deck sheet.
Figure 13:
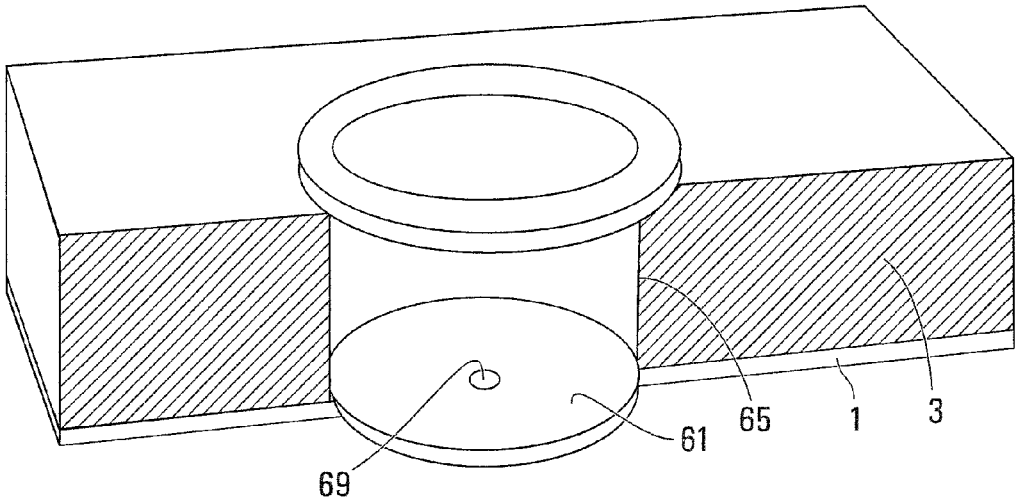
FIG. 13 is an isometric view in cross section, partially broken away, showing a deck sheet port fitting in a laminated countertop.
Figure 14:
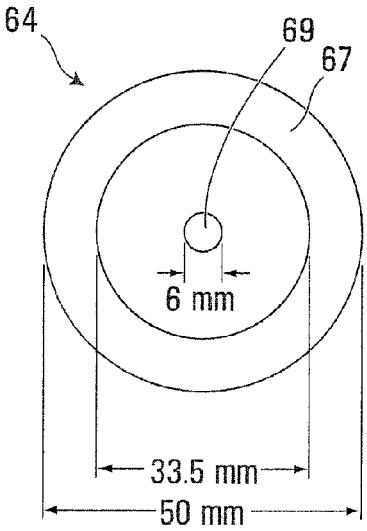
FIG. 14 is a top plan view of a deck sheet port fitting.
Figure 15:
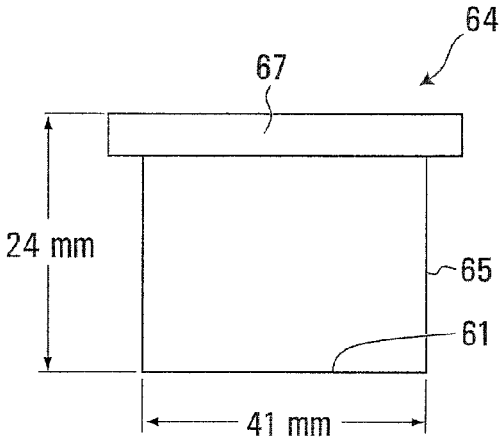
FIG. 15 is an elevational view of a deck sheet port fitting.
Figure 16:
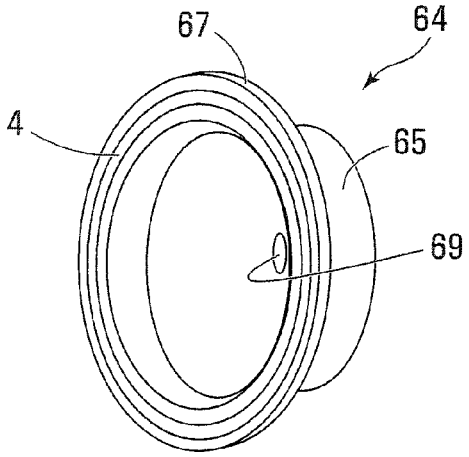
FIG. 16 is an isometric view of a deck sheet port fitting, showing a drip groove water trap in the bottom flange of the fitting.

The port fitting 64 may also be provided with a circumferential flange 67 sized to abut a bottom surface of the deck sheet 3, for example to prevent over-insertion of the fitting 64, so that the top surface 61 of the fitting 64 comes into juxtaposed relationship with the underside of the laminate 1, but does not bias the laminate 1 away from the top surface 98 of the deck sheet 3. As shown in FIGS. 11 and 12, the circumferential flange 67 on the port fitting 64 may alternatively be seated in a cut out in the bottom surface 96 of the deck sheet 3, so that the bottom surface of the flange is generally coplanar with the bottom surface 96 of the deck sheet 3. Alternatively, as shown in FIGS. 10 and 13, the flange 67 may protrude from the bottom surface 96 of the deck sheet 3.

Figure 17:
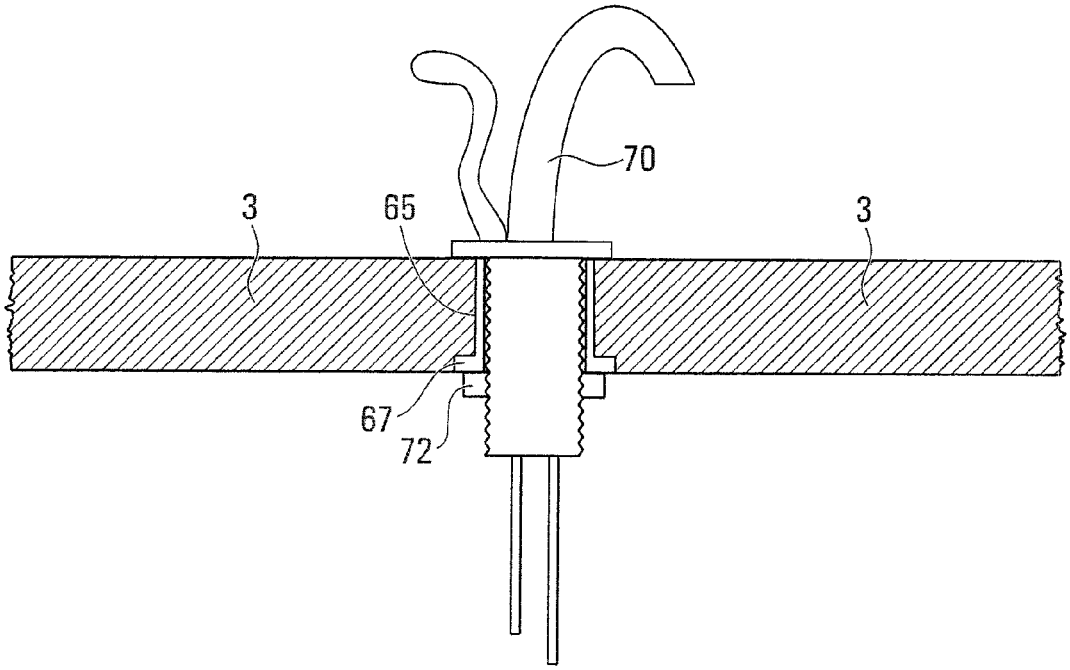
FIG. 17 is an elevational view in cross section, showing a deck sheet port fitting used with a facet.

As shown in FIG. 17, The deck sheet port fitting 64 provides a sealed passage through the deck sheet 3, which may be used for faucets 70 or other hardware. In addition to sealing the passage through the deck sheet 3, the port fitting 64 provides a supporting framework for the installation of the hardware 70. For example, a nut 72 securing a faucet 70 to the deck sheet 3 may be tightened against the flange 67 of the port fitting 64, to draw faucet 70 down against the top surface of the walls 65 of the fitting, rather than bearing against the deck sheet 3. In this way, the port fitting 64 helps to reduce the risk that the installation of hardware passing through the deck sheet will damage the laminate 1 or the sheet itself.

Figure 18:
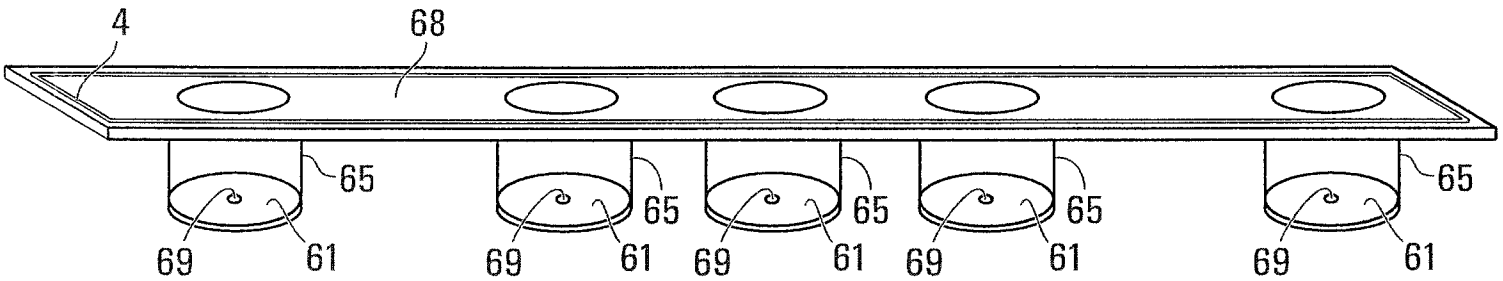
FIG. 18 is an isometric view of a deck sheet port fitting assembly, illustrating a unitary assembly of a number of fittings.

FIG. 18 illustrates an alternative embodiment of the deck sheet port fitting, in which a unitary assembly includes a number of fittings defined by side walls 65 and top surfaces 61, each of which has a relief hole 69 as described above. The port fitting assembly may for example be installed in a laminated countertop to provide an installer with optional ported passages through the countertop. The installer may accordingly choose to use one or more of the alternative fittings in the assembly, depending on the desired arrangement of countertop hardware, such as faucets and soap dispensers. In this embodiment, the circumferential flange of the port fitting is replaced by a unitary support plate 68, which is common to the port fittings in the assembly.

An alternative aspect, the invention provides methods for inserting a mounting unit in a laminated countertop, for example to adapt the countertop for under-mounting a fixture or simply to provide a sealed passage through the countertop. An aperture is cut in a porous deck sheet 3, so that a cross-sectional edge 14 defines the aperture in the sheet 3. A non-porous insert 90 is placed in the aperture, and the perimeter 17 of the insert is bonded to the cross-sectional edge 14 in the sheet 3. The top surface 19 of the insert 90 will generally be coplanar with the top surface 98 of the deck sheet 3. A non-porous laminate sheet 1 may be bonded to the top surface 98 of the deck sheet 3 and to the top surface 19 of the insert 90, in sealing engagement with the top surface 98 of the deck sheet 3 and the top surface 19 of the insert 90. The insert 90 may be provided with a recessed portion 11 having a rim 15, and reinforcing projections 10, as described above. The step of bonding the laminate sheet 1 to the deck sheet 3 may involve applying a laminating pressure to compress the laminate onto the top surface of the deck sheet and the top surface of the insert. Alternative steps may involve shaping the laminate, for example in post and cove forming procedures. To apply the laminating pressure, in a static process, platens may be used to press the laminate onto the deck sheet, bearing on the laminate sheet and on the bottom surface of the deck sheet to compress the laminate between the platens. Alternatively, in a continuous process, rollers may be used to apply the laminating pressure, bearing on the laminate sheet and on the bottom surface of the deck sheet to compress the laminate.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

What is claimed is:

1. A countertop mounting unit comprising:

a porous deck sheet having a generally planar top surface and a generally planar bottom surface, the sheet having a cross-sectional edge defining an aperture in the sheet;

a non-porous insert occupying the aperture in the sheet, the perimeter of the insert being bonded by an adhesive to the cross-sectional edge in the sheet, the insert having a top surface and a bottom surface, the top surface of the insert being generally coplanar with the top surface of the deck sheet, wherein a circumferential drip groove water trap forms a discontinuity on the bottom surface of the insert, between a downwardly-projecting circumferential rim and the cross-sectional edge;

a non-porous laminate sheet bonded to the top surface of the deck sheet and to the top surface of the insert, in sealing engagement with the top surface of the deck sheet and the top surface of the insert; and, a recessed portion of the bottom surface of the insert, formed above a plane defined by the bottom surface of the deck sheet, the recessed portion being circumscribed by the downwardly-projecting circumferential rim forming a portion of the bottom surface of the insert.

2. The countertop mounting unit of claim 1, further comprising reinforcing portions projecting downwardly from the recessed portion of the bottom surface of the insert to form reinforcing surfaces that are generally coplanar with the bottom surface of the deck sheet.

3. The countertop mounting unit of claim 2, wherein the reinforcing portions are arranged to provide a second circumferential rim concentrically located within the recessed portion defined by the rim.

4. The countertop mounting unit of claim 1, wherein no portion of the bottom surface of the insert extends below the plane formed by the bottom surface of the deck sheet.

5. The countertop mounting unit of claim 1, further comprising a fixture having a circumferential outwardly extending upper flange in sealing engagement with the bottom surface of the insert.

6. The countertop mounting unit of claim 1, further comprising a fixture having a circumferential outwardly extending upper flange in sealing engagement with the bottom surface of the insert, wherein the circumferential drip groove water trap is spaced apart from a distal edge of the flange.

7. The countertop mounting unit of claim 1, and a fixture having a circumferential outwardly extending upper flange sized for sealing engagement with the bottom surface of the insert.

8. A countertop mounting unit comprising:

a porous deck sheet having a generally planar top surface and a generally planar bottom surface, the sheet having a cross-sectional edge defining an aperture in the sheet;

a non-porous insert occupying the aperture in the sheet, the perimeter of the insert being bonded by an adhesive to the cross-sectional edge in the sheet, the insert having a top surface and a bottom surface, the top surface of the insert being generally coplanar with the top surface of the deck sheet;

a non-porous laminate sheet bonded to the top surface of the deck sheet and to the top surface of the insert, in sealing engagement with the top surface of the deck sheet and the top surface of the insert;

a recessed portion of the bottom surface of the insert, formed above a plane defined by the bottom surface of the deck sheet, the recessed portion being circumscribed by a downwardly-projecting circumferential rim forming a portion of the bottom surface of the insert; and reinforcing portions projecting downwardly from the recessed portion of the bottom surface of the insert to form reinforcing surfaces that are generally coplanar with the bottom surface of the deck sheet, wherein the reinforcing portions are arranged to provide a second circumferential rim concentrically located within the recessed portion defined by the rim.

9. The countertop mounting unit of claim 8, further comprising a fixture having a circumferential outwardly extending upper flange in sealing engagement with the bottom surface of the insert.

10. A kit comprising the countertop mounting unit of claim 9, and a fixture having a circumferential outwardly extending upper flange sized for sealing engagement with the bottom surface of the insert.

* * * * *